US005830833A

United States Patent [19]

Grasshoff et al.

[11] Patent Number: 5,830,833

[45] Date of Patent: Nov. 3, 1998

[54] SYNTHETIC ESTER LUBRICANTS FOR REFRIGERATOR SYSTEMS

[75] Inventors: Hans Dieter Grasshoff, Hamburg; Vladislav Synek, Buxtehude; Harald Kohnz, Oberhausen, all of Germany

[73] Assignee: RWE-DEA Aktiengesellschaft fur Mineraloel und Chemie and Texaco Deutschland GmbH, Germany

[21] Appl. No.: 418,303

[22] Filed: Apr. 10, 1995

Related U.S. Application Data

[63] Continuation-in-part of Ser. No. 931,840, Aug. 18, 1992, abandoned.

[51] Int. Cl.[6] ..... C10M 105/35; C10M 105/38

[52] U.S. Cl. ..... 508/485

[58] Field of Search ..... 252/56 R, 56 S, 252/68; 508/485

[56] References Cited

U.S. PATENT DOCUMENTS

| | | | |
|---|---|---|---|
| 2,807,155 | 9/1957 | Williamitis | 252/56 R |
| 3,562,300 | 2/1971 | Chao et al. | 260/398 |
| 4,826,633 | 5/1989 | Carr et al. | 252/56 S |
| 5,185,092 | 2/1993 | Fukuda et al. | 252/56 S |
| 5,202,044 | 4/1993 | Hagihara et al. | 252/68 |

FOREIGN PATENT DOCUMENTS

| | | |
|---|---|---|
| 430657 | 6/1991 | European Pat. Off. . |
| 435253 | 7/1991 | European Pat. Off. . |
| 458584 | 11/1991 | European Pat. Off. . |
| 480479 | 4/1992 | European Pat. Off. . |
| 485979 | 5/1992 | European Pat. Off. . |
| 0406479 | 4/1994 | European Pat. Off. . |
| 9012849 | 11/1990 | WIPO . |

*Primary Examiner*—Margaret Medley
*Attorney, Agent, or Firm*—David L. Mossman; Thomas H. Whaley

[57] ABSTRACT

Lubricants for refrigeration equipment operating with fluorocarbons as refrigerants are produced by esterification of at least one neopolyol type polyhydric alcohol with an acid component comprising 60 to 80 mol percent n-pentanoic acid, from about 40 to about 10 mol percent of at least one straight chain $C_6$ to $C_{10}$ monocarboxylic acid and from about 0 to about 30 mol percent $C_6$ to $C_{10}$ branched chain monocarboxylic acid. The resulting esters are suitable for use without lubricating oil additives.

19 Claims, No Drawings

SYNTHETIC ESTER LUBRICANTS FOR REFRIGERATOR SYSTEMS

This a continuation-in-part of our U.S. patent application, Ser. No. 07/931,840, filed Aug. 18, 1992, now abandoned.

This invention concerns lubricants, based on synthetic esters, that are suitable for the lubrication of refrigerator systems, heat pumps, and related systems, such as air conditioning systems, and especially for the lubrication of refrigerator systems operated with fluorocarbon refrigerants such as tetrafluoroethane, difluoroethane, and a similar compounds.

BACKGROUND OF THE INVENTION

A variety of compounds are used as refrigerants. The refrigerant HFC 134a (1,1,1,2-tetrafluoroethane, chemical formula $CFH_2$—$CF_3$) is used primarily as a replacement product for the refrigerant CFC 12 (dichlorodifluoromethane, chemical formula $CC1_2F_2$) which, besides others such as CFC 11 (trichloromonofluoromethane, chemical formula $CC1_3F$), is largely responsible for the depletion of the ozone layer. Because of the environmental hazard, chlorofluorocarbons of the CFC 12 or CFC 11 type will not be used in the future. According the 'Montreal Protocol on Substances that deplete the Ozone Layer' of 1987, as well as other international agreements, they are to be replaced by compounds that do not cause this type of environmental damage. Such compounds include the refrigerants HFC 152a, difluoroethane, HFC 32 (difluoro-methane), HFC 23 (trifluoromethane), HFC 143 (trifluoro-ethane), HFC 125 (pentafluoroethane).

Lubricants for refrigerator systems today, still consist to a greater extent of highly refined mineral oils which, in order to improve low-temperature flow properties, are de-waxed to a greater extent than is usual for lubricating oils. Synthetic or semi-synthetic refrigeration oils based on alkylbenzenes are also used in substantial quantities, as described, for example, in German Patent No. DE-PS 35 22 165.

There is also some limited use of polyalphaolefins. Use of pentaerythritol ester as refrigeration oil is described in U.S. Pat. No. 2,807,155 of Sep. 24, 1957.

Conventional refrigeration oils, whether based on mineral oils or synthetic fluids, have all been used in combination with the traditional refrigerants.

The compatibility of refrigerant and refrigeration oil is of vital importance for proper functioning of a refrigeration compressor. The thermodynamic properties and flow characteristics of the working fluid, consisting of refrigerant and lubricant, their miscibility and chemical stability are factors that have to be taken into account in selecting a lubricant.

Conventional hydrocarbon base refrigeration oils are not suitable for use with the newer refrigerants because the fluorocarbons have inadequate solubility in those media. The cause is their higher polarity in comparison with CFC 12, which is due to the asymmetry of their molecules, for example $CH_2F$—$CF_3$ (HFC 134a) or $CHF_2$—$CH_3$ (HFC 152a).

Use of synthetic esters for lubrication purposes has been known for many years. The large variety of carboxylic acids (mono-, di-, polycarboxylic acids) and alcohols, from monohydric alcohol to polyols, allows an almost unlimited number of esters to be synthetized, with extremely different property and structures. In lubrication technology, especially monocarboxylic esters, dicarboxylic esters, and polyol esters have been successfully used. Among the polyol esters, especially 'neopentyl polyol esters', should be mentioned which have a high thermal stability because of their particular chemical structure: they have no hydrogen attached to the beta carbon atom of the alcohol. This group of alcohols includes neopentylglycol, trimethylolpropane, pentaerythritol etc. Esters of this type are preferred for use in aircraft engines operating under high thermal loads and in applications where conventional, mineral-base lubricants reach their performance limits.

The use of esters of pentaerythritol and dipentaerythritol as lubricants in refrigeration systems employing fluorochlorocarbons as refrigerants was described in Williamitis (U.S. Pat. No. 2,807,155) in 1957. At the ASHRAE meeting in Jan. 1989, K. S. Sanvordenker reported on the suitability of neopentyl esters as lubricants in systems using the fluorocarbon HFC 134a as refrigerant.

However, as chlorofluorocarbons (CFC 12) were being phased out and replaced by polar fluorocarbons (HFC 134a), even though used in combination with polar esters as lubricants, unexpected compressor lubrication problems were observed. Although the lubricating properties of esters are clearly superior to those of the mineral base or alkyl benzene lubricants traditionally used in CFC 12 systems, compressor field tests proved that in combination with HFC 134a they often failed to meet performance requirements.

The unusually poor lubricating quality of the esters in systems using fluorocarbon refrigerants, as compared to conventional systems based on CFC 12/mineral oil, is attributable to the difference in the chemical composition of the two halogenated hydrocarbons. While CFC 12, owing to its chlorine content, has inherent wear reducing properties, HFC 134a is largely inactive and, because of its polarity, even reduces the effect of ester on the metal surface. This phenomenon has been described by S. Komatsuzaki in his article 'Polyol Esters as HFC 134a Compressor Lubricants', published in Lubrication Engineering, Volume 50, 10, 801–807.

In an attempt to overcome this problem, wear-reducing additives were added to ester based lubricants as is state-of-the-art in other lubricants. Use of additives with esters, for example to prevent wear, improve oxidation stability or corrosion prevention, is a standard procedure required for applications like rolling bearing lubrication or hydraulic systems. However, lubrication of refrigeration compressors is a special case. Ester and refrigerant operate in a hermetically enclosed system under pressure, frequently as a lifetime lubrication system. This environment requires high hydrolytic stability of the ester. However, tests have also shown that esters containing additives do not have the stability required in this application because released carboxylic acids may cause damage to the refrigeration system by plugging capillaries, corroding metals etc., and even causing early system failure.

STATEMENT OF THE INVENTION

A primary object of this invention is to provide ester lubricants in which chlorine free compounds, such as HFC 134a, are used as refrigerants without the need for any additives.

An object of the present invention is, therefore, to make available, as lubricants for refrigerator systems superior synthetic ester lubricants which in combination with the said fluorocarbons ensure trouble-free operation of refrigerator systems over extended periods of time.

In accordance with this invention, that objective is achieved by making available refrigeration lubricants consisting essentially of an ester or ester mixture resulting from the reaction of monocarboxylic acids of straight-chain C-numbers 5 to 10, optionally with smaller quantities of branched chain monocarboxylic acids of C-numbers 6 to 10, as the acid component, and polyhydric alcohols of the 'neopolyol type', such as neopentyl glycol, trimethylol propane, or pentaerythritol.

Contrary to expectations, it was found that only a few carboxylic acids of polyols are suitable for manufacturing esters providing adequate lubrication without additives in the presence of HFC 134a and, at the same time, meeting the requirements of this special application, which are miscibility with polar refrigerants, on the one hand, and hydrolytic stability, on the other.

It has now been discovered that unbranched monocarboxylic acids of C-numbers 5–10, preferably $C_5$, when esterified with neopolyols, optionally with small proportions of branched monocarboxylic acids, will produce such lubricants.

The esters according to this invention characteristically have good viscosity-temperature properties. This property is important insofar as their viscosity is sufficient for lubrication at higher temperatures despite the fact that their initial viscosity is relatively low, for example 15 $mm^2/s$ at 40° C. Low viscosity at low temperatures ensures an easy lubricant flow from the refrigeration unit back to the compressor and provides better heat transfer due to lower film thickness in the evaporator. Better heat transfer means a higher refrigerating capacity of the refrigeration system, and thus energy savings.

Therefore, the viscosity index, internationally accepted as a measure of viscosity-temperature performance, of the esters according to this invention is high for this type of application, in the range of from about 110 to about 150.

In accordance with this invention, lubricants suitable for use with fluorocarbon refrigerants, such as HFC 134a are produced by esterification of an alcohol component made up of one or more polyhydric alcohols from the group pentaerythritol, dipentaerythritol, neopentylglycol, and trimethylolpropane with an acid component made up of a mixture of monocarboxylic acids comprising from about 60 to about 80 mol percent n-pentanoic acid, from about 40 to about 10 mol percent of at least one $C_6$ to $C_{10}$ straight chain monocarboxylic acid, and from about 0 to about 30 mol percent $C_6$ to $C_{10}$ branched chain monocarboxylic acid. Sufficient acid is employed so that all of the OH groups in the alcohol component are esterified. One indication of purity is the neutralization number determined according to DIN 51558. Another indicator of complete esterification is the OH value determined according to DIN 53240. The esters produced according to this invention have preferably a neutralization number not greater than about 0.05 mg KOH/g, preferably 0.03 or lower, as determined according to DIN 51558, and an OH number not greater than 4 mg KOH/g as determined according to DIN 53240. The desired product esters have a viscosity index above 110, preferably in the range of 110 to 150.

As shown in the following examples, polyol esters with substantially higher concentrations of monocarboxylic acids, which also have a structure compatible with polar refrigerants and are used in refrigeration applications, provide clearly inferior wear protection compared to esters according to this invention. To improve the lubricating properties of such esters to the level of esters according to this invention, either special additives have to be used or the viscosity of the ester has to be increased. Both of these measures have application drawbacks. While wear reducing additives, as has been mentioned earlier, impair the hydrolytic stability of esters because of their chemical reactivity, use of higher viscosity esters causes energy losses in the refrigeration system.

EXAMPLES

Table 1 shows 13 examples of esters of different structures and viscosities. Depending on their concentration of carboxylic acids, they have very different lubricating properties. The lubricating properties were tested using a modified Falex method (ASTM-D 3233) developed by H. O. Spauschus and presented during a seminar in Tokyo in February 1993. The test materials used were V-blocks made of 390 aluminum in combination with steel journals (3135 steel). The direct load applied was 250 lbs. The esters used in each case were saturated with HFC 134a.

Examples 4, 5, 7, 8, 10, and 13 show test results obtained from lubricating esters produced in accordance with the subject invention. Examples 1–3, 6, 9, 11, and 12 show test results obtained with esters falling outside the range of components selected in accordance with this invention.

TABLE 1

Antiwear-Properties of Esters Dependent on Viscosity and Structure

| | Alcohol | | Carboxylic Acids | | Viscosity, $mm^2/s$ | | | Antiwear Properties Mod. Falex Method | |
|---|---|---|---|---|---|---|---|---|---|
| Example | Type | Mol. % | Type | Mol. % | 40° C. | 100° C. | VI | Pin Loss, g | Film Load, psi |
| 1 | NPG | 100 | nC7 | 17 | 9.986 | 2.676 | 105 | 0.097 | 8600 |
| | | | iC7 | 8 | | | | | |
| | | | iC9 | 75 | | | | | |
| 2 | NPG | 80 | iC8 | 100 | 9.8 | 2.45 | 56 | 0.126 | 8900 |
| | PE | 20 | | | | | | | |
| 3 | TMP | 100 | nC5 | 53 | 12.19 | 2,955 | 90 | 0.151 | 8500 |
| | | | iC5 | 27 | | | | | |
| | | | iC8 | 20 | | | | | |
| 4 | TMP | 100 | nC5 | 77 | 11.57 | 2.988 | 113 | 0.050 | 10800 |
| | | | nC8 | 13 | | | | | |
| | | | nC10 | 10 | | | | | |
| 5 | PE | 80 | nC5 | 60 | 15.01 | 3.552 | 119 | 0.045 | 11200 |
| | NPG | 20 | nC7 | 30 | | | | | |
| | | | iC7 | 10 | | | | | |

TABLE 1-continued

Antiwear-Properties of Esters Dependent on Viscosity and Structure

| | Alcohol | | Carboxylic Acids | | Viscosity, $mm^2/s$ | | | Antiwear Properties Mod. Falex Method | |
|---|---|---|---|---|---|---|---|---|---|
| Example | Type | Mol. % | Type | Mol. % | 40° C. | 100° C. | VI | Pin Loss, g | Film Load, psi |
| 6 | NPG | 34 | | | | | | | |
| | PE | 66 | iC8 | 100 | 21.62 | 4.025 | 68 | 0.116 | 8200 |
| 7 | PE | 100 | nC5 | 70 | 20.2 | 4.4 | 129 | 0.049 | 12200 |
| | | | nC9 | 25 | | | | | |
| | | | iC8 | 5 | | | | | |
| 8 | PE | 66 | nC5 | 70 | 33.5 | 6.2 | 136 | 0.035 | 13800 |
| | DPE | 34 | nC9 | 25 | | | | | |
| | | | iC8 | 5 | | | | | |
| 9 | PE | 100 | nC5 | 55 | | | | | |
| | | | nC8 | 6 | 34.67 | 5.7 | 104 | 0.093 | 9900 |
| | | | nC10 | 4 | | | | | |
| | | | iC9 | 35 | | | | | |
| 10 | DPE | 100 | nC5 | 68 | 52.5 | 8.7 | 143 | 0.033 | 12600 |
| | | | nC8 | 20 | | | | | |
| | | | nC10 | 12 | | | | | |
| 11 | PE | 39 | nC7 | 53 | 78.38 | 10.51 | 119 | 0.103 | 10700 |
| | DPE | 61 | iC9 | 47 | | | | | |
| 12 | PE | 86 | iC9 | 79 | 69.16 | 9.011 | 104 | 0.243 | 9600 |
| | DPE | 14 | nC5 | 21 | | | | | |
| 13 | DPE | 100 | nC5 | 65 | 62.9 | 9.3 | 126 | 0.028 | 13900 |
| | | | nC8 | 6 | | | | | |
| | | | nC10 | 4 | | | | | |
| | | | iC8 | 25 | | | | | |

Abbreviations in Table 1 are as follows:

NPG represents neopentylglycol; PE, pentaerythritol; TMP, trimethylolpropane; and DPE, dipentaerythritol. Straight chain carboxylic acids are represented by the letter n followed by the number of carbon atoms in the acid molecule, i.e., $nC_5$, $nC_7$, $nC_8$, $nC_9$, $nC_{10}$. Branched chain carboxylic acids are represented by the letter i followed by the number of carbon atoms in the acid molecule, i.e., $iC_5$, $iC_7$, $iC_8$, $iC_9$, and do not necessarily indicate that the branched chain acids contain iso end groups. In the case of $iC_8$, the branched chain acid is 2-ethylhexanoic acid.

Since not only the chemical structure of an ester determines its lubricating properties but also its viscosity, the esters in the above examples were subdivided into three groups corresponding to ISO grades 10 to 15, 22 to 32, and a group of higher-viscosity esters approximately corresponding to ISO 68. Viscosities were measured according to DIN 51562.

Examples 1 to 5 are within the first group (group 1) corresponding to ISO grades 10 to 15; Examples 6 to 9 are within the second group (group 2) corresponding to ISO grades 22 to 32; and Examples 10 to 13 fall within the group approximately corresponding to ISO 68 (group 3).

Examples 4 and 5 in the first group are esters according to the invention. With their concentrations of 100 and 90 mol. % straight-chain carboxylic acids, they clearly differ from Examples 1 to 3 which contain 47 to 100 mol. % branched carboxylic acids. The load carrying capacity of the lubricating film of esters according to the invention is approx. 20% higher, the wear results (pin loss) are even twice to three times as good as with esters containing mostly branched carboxylic acids.

Also the second group, where Examples 7 and 8 are esters according to the invention, clearly demonstrates that polyol esters with high concentrations of unbranched carboxylic acids of chain lengths $C_5$ to $C_{10}$ achieve dramatically better wear results than esters containing high concentrations of branched carboxylic acids, as in Examples 6 and 9.

Another confirmation of the outstanding lubricating properties of esters according to the invention is provided by Examples 10 and 13 in group 3 as compared to Examples 11 and 12.

The table illustrates the difference between esters according to the invention and esters containing higher concentrations of unbranched carboxylic acids.

Looking especially at the wear rates (pin loss) in this table, one is surprised to find that the weight losses with all esters according to the invention, irrespective of their viscosity, move in a narrow range between 0.028 g (Example 13) and 0.05 g (Example 4). By contrast, the wear rates of esters having higher concentrations of branched carboxylic acids are at a definitely higher level and fluctuate considerably.

The following conclusions can be drawn from the results in Table 1: Esters according to the invention, i.e. esters with particularly good wear properties, contain at least 60% $nC_5$.

The concentration of straight-chain carboxylic acids is between 90 and 100 mol. %. in the case of esters based on neopentylglycol, trimethyololpropane, and pentaerythritol as the alcohol component. Since higher viscosities can be achieved with dipentaerythritol as alcohol component, the proportion of branched carboxylic acids in this case may be higher without impairing the good lubricating properties.

Esters as shown in the examples can be used in refrigeration systems without any admixture of additives.

They have not only excellent lubricating properties but, because of their special chemical structure, provide maximum thermal and hydrolytic stability and good solubility in polar refrigerants like 1,1,1,2-tetrafluoroethane (HFC 134a).

The high percentage of n-pentanoic acid in esters according to the invention ensures the polarity required for use as a refrigeration oil.

The esters were subjected to a test based on the ASHRAE standardized stability test (ANSI/ASHRAE 97-1989) to determine their thermal, chemical, and hydrolytic stability.

The thermal stability of pentaerythritol esters according to the invention is excellent because of their molecular structure—absence of hydrogen in the beta position of the alcohol group. Esters of this type are known to be stable up to temperatures of at least 260° C.

Tests with dried and moist samples were performed using the following procedure: Suitably prepared (cleaned and acidified) glass tubes of 200 mm length and an inside diameter of 5 to 7 mm were fusion-sealed at one end and tapered at the other end to a diameter of 1.5 mm over a length of about 5 cm. A copper wire (30 mm long, 1 mm diameter), a steel strip (50×3 mm), and an aluminum strip (30×5 mm) were inserted into these tubes. Then 1.5 g lubricant was weighed and added, and 0.7 g of HFC 134a refrigerant was added in a special fixture under vacuum and at a very low temperature. After addition of the refrigerant, the tubes were fusion-sealed in a nitrogen atmosphere. The tubes were then placed in a drying oven that had been heated for a defined period to the test temperature of 175° C. The test duration was 2 weeks. In the course of the test, the samples were visually inspected for color changes and deposits. The metals were also checked for surface changes.

The different moisture levels of the oils under investigation were produced as follows: The dried oils (moisture level 1) were taken from vessels in which they had been stored for a period of two months. These were left open for 15 minutes before the oils were filled into the test tubes. The moist samples were taken from the same (opened) vessels after storage at 95% relative humidity for one hour (moisture level 2) and 24 hours (moisture level 3), and filled into the test tubes.

The following Table gives the moisture levels for refrigeration oils 5, 6, 9, and 13.

TABLE 2

| Moisture level (ppm $H_2O$ in oil) | 1 | 2 | 3 |
|---|---|---|---|
| Example 5 | 75 | 211 | 1900 |
| Example 6 | 66 | 219 | 1700 |
| Example 9 | 83 | 203 | 1700 |
| Example 13 | 54 | 195 | 1800 |

The test results are collected in Table 3 below. They show that at least up to moisture level 2 (approx. 200 ppm water), which is quite high in practical operation, the esters are thermally and hydrolytically stable. The first signs of beginning instability of the esters are changes on the metal surface which first appear at moisture level 3. The hydrolyzation tendency was found to decrease with increasing purity of the esters after the manufacturing process. An indicator of purity is the neutralization number determined according to DIN 51558. For esters according to the present invention, it should not exceed a value of 0.03 mgKOH/g. The OH number according to DIN 53240 also is an indicator of complete esterification. It should not exceed 4 mgKOH/g.

TABLE 3

| | | Example | | | |
|---|---|---|---|---|---|
| | | 5 | 6 | 9 | 13 |
| Color | Moisture Level 1 | no change | | | |
| | Moisture Level 2 | no change | | | |
| | Moisture Level 3 | no change | | | |
| Appearance | Moisture Level 1 | Clear | Clear | Clear | Clear |

TABLE 3-continued

| | | Example | | | |
|---|---|---|---|---|---|
| | | 5 | 6 | 9 | 13 |
| | Moisture Level 2 | Clear | Clear | Clear | Clear |
| | Moisture Level 3 | Clear | Clear | Clear | Clear |
| Steel | Moisture Level 1 | no surface change | | | |
| | Moisture Level 2 | no surface change | | | |
| | Moisture Level 3 | copper traces | | | |
| Copper | Moisture Level 1 | no surface change | | | |
| | Moisture Level 2 | no surface change | | | |
| | Moisture Level 3 | dark brown | | | |
| Aluminum | Moisture Level 1 | no surface change | | | |
| | Moisture Level 2 | no surface change | | | |
| | Moisture Level 3 | no surface change | | | |

In another test, an ester according to the invention (example 7) was compared with two commercial ester-base refrigeration oils containing additives.

For that purpose, 1000 ppm water was added to the samples, which were then placed in a suitable pressure vessel and kept at 150° C. for 100 hours. This was followed by a determination of the neutralization number, an indicator of the hydrolytic stability of esters. While in example 7 an increase from 0.02 mgKOH/g to 0.75 mgKOH/g was observed, the neutralization number of the reference samples increased from 0.08 and 0.1 mgKOH/g to 1.52 and 1.6 mgKOH/g, respectively.

The suitability of esters according to the invention has also been proved directly in field tests with refrigeration compressors. Compressors made by Danfoss and Bitzer were used for these tests.

The tests were run under defined output conditions for a period of 2000 hours. After completion of the tests, the compressors and the esters used as lubricants were examined thoroughly.

No case of compressor failure occurred. All parts were in perfect condition. The lubricants themselves were unchanged in all data.

The tests were conducted under the (averaged) conditions indicated in the Table below.

TABLE 4

| Compressor type | | Danfoss TL4*) | Bitzer II*) |
|---|---|---|---|
| Suction pressure, absolute | bar | 2.80 | 2.40 |
| Compression pressure, absolute | bar | 24.20 | 13.80 |
| Pressure ratio | | 8.64 | 5.75 |
| Compression temperature | °C. | " | 160**) |
| Suction temperature | °C. | " | 113 |
| Oil sump temperature | °C. | 110 | 93 |
| Lubricant | ml | 280 | 600 |
| Refrigerant | g | 65 | 60 |

*)While the Danfoss compressors are commercial, fully hermetic compressors used, for example, in household refrigerators, the Bitzer compressors are open units for general industrial applications.
**)Measured in the cylinder head, near the discharge valve

We claim:

1. Lubricants for refrigeration compressors consisting essentially of at least one ester resulting from the reaction of at least one polyhydric alcohol selected from the group consisting of pentaerythritol, dipentaerythritol, trimethylolpropane, and neopentylglycol with an acid component consisting of from about 60 to about 80 mol percent n-pentanoic acid, and from about 40 to about 10 mol percent of at least one straight chain $C_6$ to $C_{10}$ monocarboxylic acid, and an absence of a branched chain monocarboxylic acid;

wherein the ester mixture has a viscosity index above about 110, a neutralization number not greater than 0.05 mg KOH/g determined according to DIN 51558, and an OH number of not greater than 4 mg KOH/g as determined according to DIN 53240.

2. Lubricants according to claim 1 wherein the alcohol is pentaerythritol.

3. Lubricants according to claim 1 wherein the alcohol is dipentaerythritol.

4. Lubricants according to claim 1 wherein the alcohol is a mixture of pentaerythritol and dipentaerythritol.

5. Lubricants according to claim 1 wherein the alcohol is trimethylolpropane.

6. Lubricants according to claim 1 wherein the alcohol is neopentylglycol.

7. Lubricants according to claim 1 wherein the alcohol is a mixture of pentaerythritol and neopentylglycol.

8. Lubricants for refrigeration compressors consisting essentially of at least one ester resulting from the reaction of at least one polyhydric alcohol selected from the group consisting of pentaerythritol, dipentaerythritol, trimethylolpropane, and neopentylglycol with an acid component consisting of from about 60 to about 80 mol percent n-pentanoic acid, and from about 40 to about 10 mol percent of at least one straight chain $C_6$ to $C_{10}$ monocarboxylic acid, and from about 5 to about 30 mol percent of at least one $C_6$ to $C_{10}$ branched chain monocarboxylic acid;

wherein the ester mixture has a viscosity index above about 110, a neutralization number not greater than 0.05 mg KOH/g determined according to DIN 51558, and an OH number of not greater than 4 mg KOH/g as determined according to DIN 53240.

9. Lubricants according to claim 8 wherein the branched chain monocarboxylic acids are $C_7$ to $C_9$ monocarboxylic acids.

10. Lubricants according to claim 8 wherein the branched chain monocarboxylic acid 2-ethylhexanoic acid.

11. Lubricants according to claim 8 wherein the alcohol is pentaerythritol.

12. Lubricants according to claim 8 wherein the alcohol is dipentaerythritol.

13. Lubricants according to claim 8 wherein the alcohol is a mixture of pentaerythritol and dipentaerythritol.

14. Lubricants according to claim 8 wherein the alcohol is a mixture of pentaerythritol and neopentylglycol.

15. Lubricants according to claim 11 wherein the branched chain monocarboxylic acid 2-ethylhexanoic acid.

16. Lubricants according to claim 12 wherein the acid component comprises 2-ethylhexanoic acid as the branched chain monocarboxylic acid.

17. Lubricants according to claim 13 wherein the branched chain monocarboxylic acid is 2-ethylhexanoic acid.

18. Lubricants according to claim 14 wherein the branched chain monocarboxylic acid is 2-ethylhexanoic acid.

19. Lubricants according to claim 8 wherein the alcohol is neopentylglycol and the branched chain monocarboxylic alcohol is 2-ethylhexanoic acid.

* * * * *

UNITED STATES PATENT AND TRADEMARK OFFICE

CERTIFICATE OF CORRECTION

PATENT NO : 5,830,833

DATED : November 3, 1998

INVENTOR(S) : Hans Dieter Grashoff, Vladislav Synek, Harald Kohnz

It is certified that error appears in the above-identified patent and that said Letters Patent is hereby corrected as shown below:

Column 9, line 5, please delete the word "mixture".

Column 10, line 1, please delete the word "mixture".

Column 10, line 11, please insert the word --is-- after "acid" and before "2-ethylhexanoic".

Column 10, line 21, please insert the word --is-- after "acid" and before "2-ethylhexanoic".

Signed and Sealed this

Twenty-ninth Day of June, 1999

*Attest:*

Q. TODD DICKINSON

*Attesting Officer*

*Acting Commissioner of Patents and Trademarks*